United States Patent [19]

Osborn

[11] Patent Number: 4,627,485

[45] Date of Patent: Dec. 9, 1986

[54] ROTARY REGENERATIVE HEAT EXCHANGER FOR HIGH TEMPERATURE APPLICATIONS

[75] Inventor: Henry H. Osborn, Wellsville, N.Y.

[73] Assignee: The Air Preheater Company, Inc., Wellsville, N.Y.

[21] Appl. No.: 664,124

[22] Filed: Oct. 23, 1984

[51] Int. Cl.[4] ..... F28D 19/04

[52] U.S. Cl. ..... 165/8; 165/9.1; 165/10

[58] Field of Search ..... 165/8, 10, 9.1

[56] References Cited

U.S. PATENT DOCUMENTS

| | | | |
|---|---|---|---|
| 3,058,723 | 10/1962 | Nilsson et al. | 165/10 |
| 3,072,182 | 1/1963 | Persson | 165/9 |
| 3,144,903 | 8/1964 | Stockman | 165/8 |
| 4,108,733 | 8/1978 | Gerber | 165/9.1 |

FOREIGN PATENT DOCUMENTS

| | | | |
|---|---|---|---|
| 244182 | 4/1963 | Australia | 165/8 |

*Primary Examiner*—Albert W. Davis, Jr.
*Attorney, Agent, or Firm*—William W. Habelt

[57] ABSTRACT

A rotary regenerative heat exchanger is particularly adapted for use in exchanging heat from a hot gas entering the heat exchanger at a temperature in the range of 2000°-3000° F. to low temperature air to be heated. An upper rotor and a lower rotor are supported concentrically about a rotor post mounted for rotation successively through the hot gas and air flows at a vertical axis. The hot gas enters and the heated air exits through the top of the heat exchanger, while the cooled gas exits and the cold air to be heated enters through the bottom of the heat exchanger. The upper rotor houses ceramic heat absorbent blocks adapted to withstand the high temperatures existing in the upper portion of the heat exchanger, while the low rotor houses typical metallic element suitable for use at more moderate temperatures.

2 Claims, 3 Drawing Figures

ROTARY REGENERATIVE HEAT EXCHANGER FOR HIGH TEMPERATURE APPLICATIONS

BACKGROUND OF THE INVENTION

The present invention relates to rotary regenerative heat exchange apparatus and, more particularly, to rotary regenerative heat exchange apparatus specifically adapted for use in transferring heat from a very high temperature gas, such as process gas in the temperature range of 1800° F. to 2500° F., to a much cooler gas, such as ambient air.

In a typical rotary regenerative heat exchanger, a mass of heat exchange material carried in a rotor is first positioned in a passageway of a heating fluid where it absorbs heat from the fluid flowing therethrough. Then, upon further rotation of the rotor about its axis, the heated heat absorbent material is positioned in a second fluid passageway where its heat is transferred to and absorbed by a fluid to be heated passing through the second fluid passageway. The rotor is surrounded by a housing having end openings therein to provide for the passage of the heating fluid and the fluid to be heated through the first and second fluid passages respectively. Sealing means are provided at the ends of the rotor and about the circumference of the rotor and in closely spaced relationship with adjacent housing structure to prevent, or at least minimize, intermingling of the heating fluid and the fluid to be heated.

Rotary regenerative heat exchangers of this type provide an efficient method for transferring heat between two gases, typically a hot flue gas or process gas and air, and their use is quite common in temperatures that lie within the working range of steel or various alloys that are commonly used to comprise the heat exchanger structure and the metallic heat absorbent plates. However, for temperatures that lie above the working range of metals, as may prevail in various process applications, or in appreciation of material costs, it has been necessary to utilize ceramic materials for the heat absorbent element mass, and in certain instances for the supporting heat exchanger structure itself. Rotary regenerative heat exchangers utilizing ceramic heat absorbent material for high temperature application, are well known in the art. For example, U.S. Pat. Nos. 3,101,778 and 3,209,058 show high temperature heat exchangers wherein the rotor is formed of a plurality of sector-shaped blocks of axially perforate ceramic material, and U.S. Pat. Nos. 4,316,500 and 4,331,198 wherein the rotor is formed of one or more perforate ceramic disc.

Although rotors utilizing metallic heat absorbent element are quite suitable at low and moderate temperatures, such metallic element is not suitable at high temperatures due to temperature limitations of the material itself and also because contaminants in the fluids passing through the heat exchanger are often corrosive to metal in the higher temperature range. Ceramic element on the other hand is quite suitable for high temperature application but is often very brittle and liable to breakage when subjected to thermal stress or mechanical shock. Additionally, the ceramic element can be quite expensive as it is also difficult to make in the desired shapes necessary to properly fill the rotor of the heat exchanger with such ceramic element.

Accordingly, it is an object of the present invention to provide a rotary regenerative heat exchanger for use in transferring heat from a very high temperature gas to a very cool gas wherein both metallic and ceramic heat absorbent element are utilized with each being utilized in the temperature range for which it is more suitable.

SUMMARY OF THE INVENTION

The present invention provides a rotary regenerative heat exchanger particularly adapted for use in exchanging heat from a hot gas entering the heat exchanger at a temperature in the range of 2000°-3000° F. to a much cooler gas entering the heat exchanger at a temperature of a few hundred degrees or less. In accordance with the present invention, a lower rotor and an upper rotor are mounted concentrically about and supported from a vertical rotor post adapted for rotation about a vertical axis. The lower rotor is adapted to house a mass of metallic heat absorbent element while the upper rotor, which is disposed axially above the lower rotor, is adapted to house a mass of ceramic heat absorbent element. Housing means surround the upper and lower rotors and include inlet and outlet openings at each end thereof for defining a first flow passage for passing a heating fluid therethrough from an inlet at the upper end of a housing to an outlet at the lower end thereof, and a separate second flow passage for passing a fluid to be heated therethrough from an inlet at the lower end thereof to an outlet at the upper end thereof. Bearing means are disposed at the lower end of the rotor post for supporting the rotor post for rotation about its vertical axis and for precluding lateral movement thereof. The bearing means, being disposed at the lower end of the rotor post, are at the cold end of the rotor post and are therefor not subjected to the high temperatures present at the upper end of the rotor post.

Further, the mass of heat absorbent element housed in the upper rotor preferably comprises a plurality of substantially trapezoidal-shaped ceramic blocks. Each of the ceramic blocks has a plurality of axially aligned flow passages extending therethrough and also has side plates adapted to interlock with neighboring blocks in adjacent layers.

DESCRIPTION OF THE PREFERRED EMBODIMENT

Figure 1:
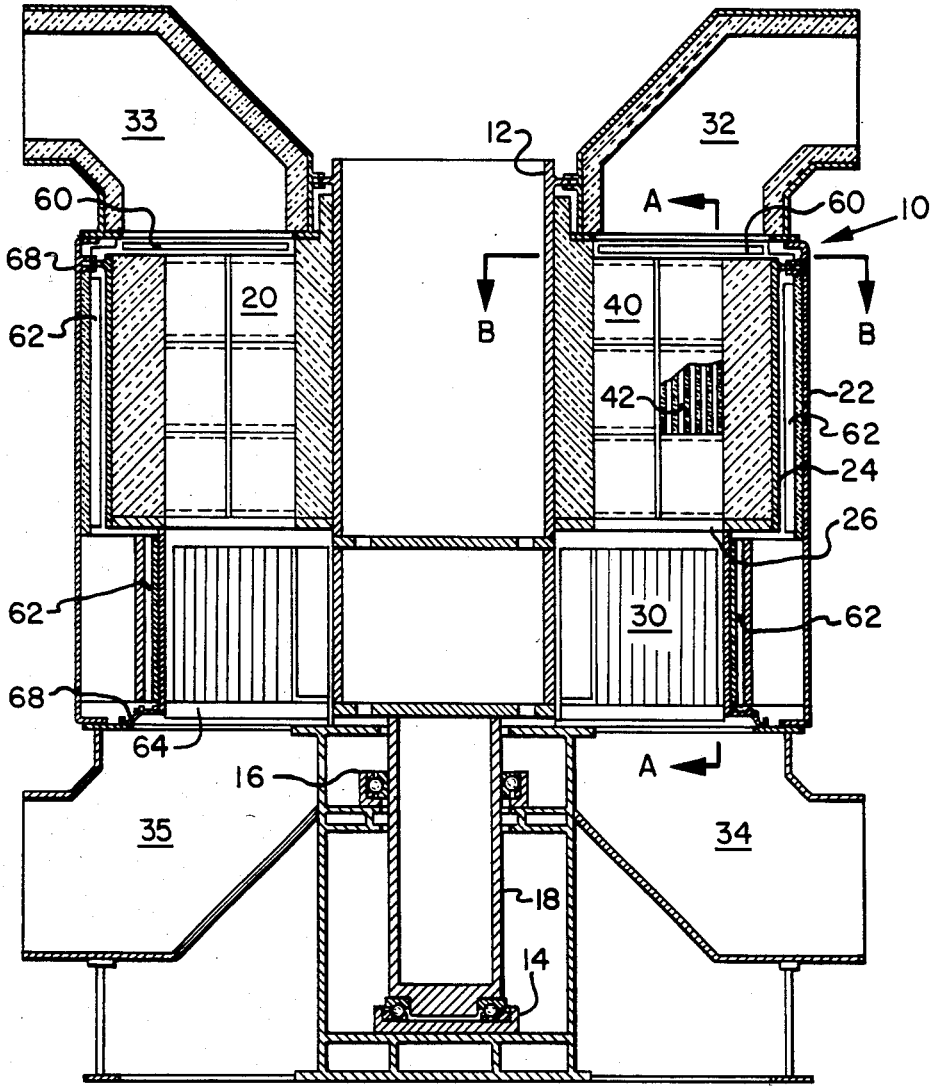
FIG. 1 is a sectional elevational view showing the rotary regenerative heat exchanger of the present invention.

Referring now to FIG. 1, there is depicted therein a rotary regenerative heat exchanger 10 uniquely adapted for transferring heat from a hot gas having a temperature in the range of 2000°-3000° F. upon entering the heat exchanger to a cold gas to be heated, such as ambient air. A mass of heat absorbent material is housed in the upper rotor 20 and the lower rotor 30 for rotation about the centrally located rotor post 12. The rotor post 12 is mounted on a support bearing 14 at its lower end and adapted to rotate about the vertical axis within a guide bearing 16 located about the lower stem 18 of the rotor post 12 at a location intermediate the support bearing 14 and the lower rotor 30.

The upper rotor 20 and the lower rotor 30 are surrounded by a housing 22 that is provided at each end thereof with an inlet and an outlet opening. The housing 22 defines a first flow passage for passing the heating fluid, i.e. the hot gas, therethrough from an inlet 32 at the upper end thereof to an outlet 34 at the lower end thereof, and a second flow passage for passing the fluid to be heated, i.e. the ambient air, therethrough from an inlet 35 at the lower end thereof opposite the gas outlet 34 to an outlet 33 at the upper end thereof opposite the gas inlet 32. As the rotor post 12 rotates about its central vertical axis, the upper rotor 20 and the lower rotor 30 mounted thereto are passed alternately through the first flow passage through which the hot gas is passing downwardly and thence into the second flow passage where the air to be heated is passing upwardly. Heat will be transferred from the hot gas as it flows downwardly through the first gas flow passage from the gas inlet 32 to the gas outlet 34 to the mass of heat absorbent material disposed in the upper rotor 20 and the lower rotor 30 as these rotors pass through the first gas flow passage. The heat absorbed by the mass of heat absorbent material disposed within the upper rotor 20 and the lower rotor 30 will be transferred to the air to be heated passing upwardly through the second flow passage from the air inlet 35 to the air outlet 33 as the rotor post 12 continues to rotate causing the hot mass of heat absorbent material within the rotors 20 and 30 to pass from the first flow passage into and through the second flow passage.

In order to reduce leakage between the sector shaped compartments of the rotors 20 and 30, top radial seals 60, axial seals 62, and bottom radial seals 64, are provided which cooperate with the housing surrounding the rotor to provide the sealing function. Additionally, circumferential seals 68 are provided around the upper edge of the upper rotor 20 and the lower edge of the lower rotor 30 which cooperate with the housing to preclude flow bypassing.

Due to the direction of air and gas flow through the heat exchanger 10, the upper portion of the heat exchanger 10 can be referred to as the hot end while the lower portion of the heat exchanger 10 can be referred to as the cold end. As the hot gas enters the heat exchanger through inlet 32 at the top thereof and the heated air leaves the heat exchanger through the outlet 33 at the top thereof, the maximum mean gas temperature will be experienced at the upper end of the heat exchanger 10. Similarly, as the cooled gas leaves the heat exchanger 10 through the gas outlet 34 at the bottom thereof and the cold air to be heated enters through the air inlet 35 at the bottom thereof, the lower end of the heat exchanger 10 will experience the minimum mean temperature. Further, the temperature will gradually decrease from the top of the heat exchanger 10 to the bottom of the heat exchanger 10. Therefore, the upper rotor 20 will experience the higher material temperature, while the lower rotor 30 will experience the lower material temperature.

Therefore, in accordance with the present invention, the lower rotor 30, which is mounted concentrically about and supported from a lower region of the vertical center rotor post 12, houses a mass of metallic heat absorbent element typically of the type commonly used in the prior art low temperature heat transfer applications. Typically, the metallic heat absorbent element disposed in the lower rotor 30 comprises a plurality of thin metallic plates cut to fit into a framework of sectionedshaped compartments extending radially outward from the center rotor post 12. The upper rotor 20, which is mounted concentrically about and supported from an upper region of the vertical center rotor post 12 and disposed axially about the lower rotor 30, houses a mass of ceramic heat absorbent element. This ceramic heat absorbent element could be made from a number of commercially available ceramics of the type presently utilized in high temperature heat exchangers, such as, but not limited to, silicon carbide or silicon nitride. Therefore, in accordance with the present invention, the portion of the rotor which is exposed to gas temperatures and air temperatures above the acceptable limit for metallic element is filled with a ceramic element, while the lower portion of the rotor, i.e. that portion of the rotor at which the temperatures are within acceptable limits, is filled with typical metallic element. In this manner, an economical and compact rotor can be constructed which is specifically adapted for transferring heat from a hot gas having a temperature upon entering the air heater in the range of 2000°–3000° F. to a much cooler gas to be heated, such as ambient air.

Further in accordance with the present invention, the bearing means for supporting the rotor post 12 and guiding the rotor post 12 in its rotation are disposed at the cold end of the air heater so that they are not exposed to the high gas temperatures present at the hot end of the heat exchanger 10 and the adverse effects attendant therewith. In accordance with applicant's invention, not only the support bearing 14, but also the guide bearing 16, are disposed at the cold end, i.e. the lower end, of the heat exchanger 10. As noted hereinbefore, the lower stem 18 of the central rotor post 12 which extends vertically downward therefrom is mounted to and sets upon the support bearing 14 disposed beneath the lower end of the central rotor post 12 for supporting the rotor post 12 for rotation about its vertical axis, and the guide bearing 16 is disposed about the lower stem 18 of the rotor post 12 intermediate the support bearing 14 and the lower rotor 30 of the heat exchanger 10. Therefore, the guide bearing 16 is also disposed at the cold end of the heat exchanger 10 rather than being disposed about the upper end of the central rotor post 12 at the hot end of the heat exchanger 10 as is common in typical prior art rotary regenerative heat exchangers.

The mass of ceramic heat absorbent material disposed in the upper rotor 20 consists of a plurality of interlocking ceramic blocks. Each of the ceramic blocks 40 has a plurality of axially aligned flow channels 42 extending therethrough through which the heating fluid and the fluid to be heated pass as the upper rotor 20 passes through the first and second flow passages through the heat exchanger housing 22. The flow channels 42 may be of any desirable cross-section, which will typically be of a rectangular cross-section. The ceramic blocks 40 are housed in an annular basket shell 24 supported from the upper portion of the central rotor post 12. The blocks 40 are supported on spoke-like members 26 making up the floor of the basket shell 24 of the upper rotor 20. The ceramic element blocks 40 are disposed in the upper rotor 20 intermediate the radially outward wall of the shell 24 and the central rotor post 12 with the flow channels 42 through the blocks 40 aligned with the axis of the central rotor post 12 so as to facilitate gas flow therethrough. In order to protect the metallic rotor post 12 and the metallic basket 24 from the hot gas and air temperatures, an annular layer of installation 28 is disposed about the central rotor post 12 and an annular layer of insulation 29 is disposed about the inner wall of the cylindrical basket shell 24 with the ceramic element blocks 40 disposed intermediate the insulation layers 28 and 29.

Figure 2:
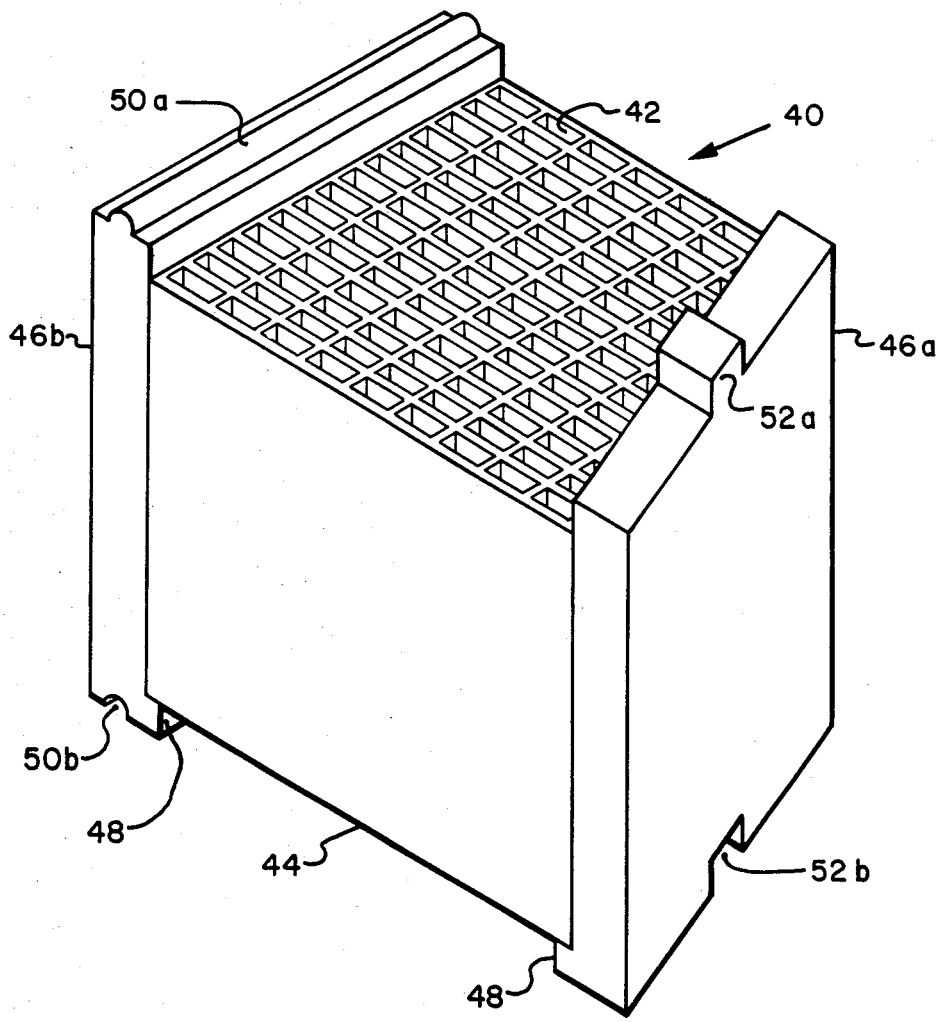
FIG. 2 is a perspective view showing a preferred embodiment of a ceramic element block for use in the upper rotor of the rotary regenerative heat exchanger shown in FIG. 1.

Although ceramic blocks 40 housed in the upper rotor 20 may take on any particular shape, i.e. they may have a square cross-section, a trapezoidal cross-section, or a rectangular cross-section or other cross-sections and may be cubes or elongated parallel pipeds, the perferred embodiment of the blocks 40 presently contemplated for use in the upper rotor 20 of the heat exchanger 10 of the present invention is shown in FIG. 2. Each of the ceramic blocks 40 would be comprised of a central body 44 perforated with a plurality of axially aligned flow channels 42 and disposed between and mounted to or formed integrally with side plates 46A and 46B which extend along the non-circumferential sides of the block 40. The side plates 46A and 46B would be either formed integrally with the center body 44 of the block 40 during the manufacturing process or cemented thereto during the manufacturing process with suitable temperature resistant cements. Preferably, each of the side plates 46A and 46B has a lower lip 48 extending along the inward edge thereof beneath the center body 44 of the ceramic block 40 so as to provide a support surface upon which the center body 44 rests. This lip 48 will serve to support the center body 44 of the ceramic blocks 40 in the event that the center body 44 becomes dislodged during service from the side plates 46A and 46B due to failure of the cement to hold along the interface between the center body 44 and the side plates 46A and 46B. Without the lip 48, the center body 44 would, if it became dislodged during service, drop down onto the next layer of ceramic blocks and result in damage to those blocks and partial flow blockage.

As can be seen in FIG. 2, the side plates 46A and 46B extend upwardly and downwardly beyond the center body 44 a distance d. This extension of the side plates 46A and 46B upwardly and downwardly beyond the center body 44 provides for a gap of a spacing equal to two times the distance d between adjacent stacked layers of ceramic blocks. It is preferable that this gap be provided between adjacent layers of ceramic blocks in order to preclude any blockage of the flow channels 42 of the blocks 40 in adjacent layers. If the blocks 40 of adjacent layers merely rested upon each other, it is entirely possible, in fact probable, that movement of the blocks during service as the upper rotor 20 rotates through the gas and air stream would result in the shifting of the blocks 40 of adjacent layers such that the flow channels 42 would become misaligned between adjacent layers. Even a minor misalignment between the flow channel 42 would have an adverse effect on gas flow through the blocks and result in increased pressure drop through the heat exchanger.

Additionally, it is preferable that the side plates 46A and 46B be provided along their upper and lower surfaces with an interlock means for mating blocks 40 of adjacent layers of the upper rotor 30 so as to interlock together to preclude or at least minimze movement during service. The interlock means may comprise a tongue and mating groove arrangement such as shown on side plate 46B of FIG. 2 wherein a tongue 50A extends along the upper edge of the side plates 46 and a mating groove 50B that-extends along the lower edge of the side plate 463 so that when the blocks 40 are stacked within the upper rotor 30, the tongues 50A of a block would mate into the groove 50B of the block disposed in the next layer thereabove. Another arrangement of interlocking means would be a protrusion and mating intrusion as shown in FIG. 2 on side plate 46A. A protrusion 52A would extend upwardly from the upper surface of the side plate 46A and a mating intrusion 52B would be formed in the lower edge of the side plate 46A. Again, when the blocks were stacked within the upper rotor 30, the protrusion 52A would mate into the intrusion 52B of the adjacent block in the next above layer of ceramic blocks so as to interlock the blocks and layers together.

Figure 3:
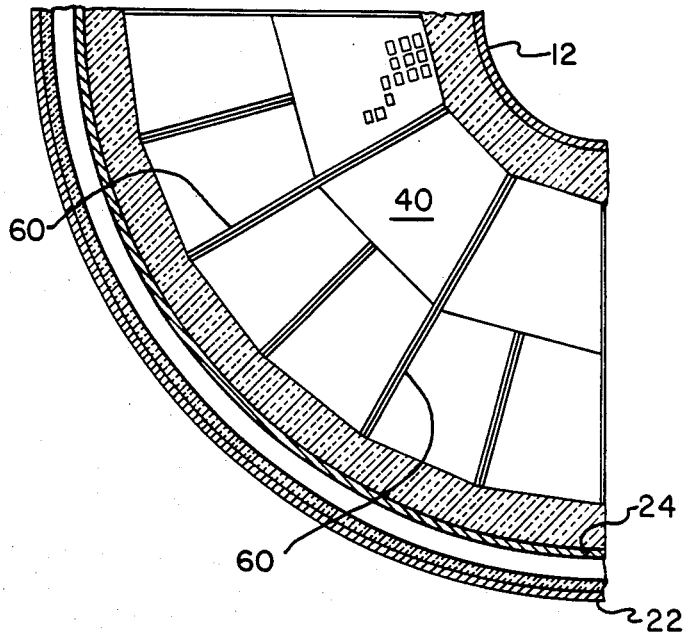
FIG. 3 is a sectional plan view showing a quarter sector of the upper rotor of the rotary regenerative heat exchanger of FIG. 1 taken along line 3—3 of FIG. 1.

Further, it is preferred that at least one side plate of each of the ceramic blocks 40 be orientated to extend in a plane alignable along a radius extending outwardly from the vertical axis of the center post 12 when the blocks are disposed within the upper rotor 30. As best seen in FIG. 3, when blocks of such a design are disposed within the basket of the upper rotor 30, the radially extending side plates can be aligned along a radius extending outwardly from the center post 12 to form a solid radially extending diaphragm 60 between adjacent sectors of the upper rotor 30. With the blocks of adjacent layers interlocking, in effect a solid diaphragm plate 60 would be formed in a plane extending radially outward from the center post 12 and extending over the entire height of the upper rotor 20 so as to form a plurality of sector-shaped compartments between adjacent diaphragm plates 60. The ceramic diaphragm plates 60 would provide a surface against which the top radial seals of the heat exchanger 10 would seal against gas and air leakage. Further, it is to be understood that the circumferentially innermost and circumferentially outermost row of blocks may be trimmed along their circumferentially innermost surface and circumferentially outermost surface respectively to conform to an arc of a circle in order to more nearly conform to the cylindrical shape of the upper rotor 20.

While the present invention is described and illustrated herein in relation to a rotary regenerative heat exchanger for the purpose of heating air to a high temperature by transfer of heat from a hot flue gas, it is to be understood that the present invention may be applied for use in transferring heat to any cold fluid from any very hot fluid having a temperature upon entering the heat exchanger in excess of that suitable for the use of metallic heat absorbent element. Further, it is to be understood that the specific embodiment shown in the drawing is merely illustrative of the best mode presently contemplated by the applicant for carrying out the invention. Accordingly, it is intended that any modification which may be apparent to those skilled in the art in light of the foregoing description and which falls within the spirit and scope of the appended claims be included in the invention as recited in the appended claims.

What is claimed is:

1. A rotary regenerative heat exchanger comprising:

a. A vertical rotor post adapted for rotation about a vertical axis;

b. a lower rotor mounted concentrically about and supported from a lower region of said vertical rotor post, said lower rotor adapted to house a mass of metallic heat absorbent element;

c. an upper rotor mounted concentrically about and supported from an upper region of sAid vertical rotor post, said upper rotor disposed axially above said lower rotor, said upper rotor adapted to house a mass of ceramic heat absorbent element comprised of a plurality of substantially trapezoidal shaped ceramic blosks disposed in at least two layers about said rotor post, each of said ceramic blocks having a plurality of axially aligned flow channels extending therethrough and having a pair of side plates disposed along opposite sides thereof adapted to interlock with a neighboring block in an adjacent layer of said upper rotor;

d. housing means surrounding the upper and lower rotors add including inlet and outlet openings at each end thereof, said housing means defining a first flow passage for passing heating fluid therethough from an inlet at the upper end thereof to an outlet at the lower end thereof and a second flow passage for passing a fluid to be heated therethrough from an inlet at the lower end thereof to an outlet at the upper end thereof, whereby heat will be transferred from the heating fluid to said ceramic and metallic heat absorbent element as the upper and lower rotors rotate through the first flow passage and thence from said ceramic and metallic heat absorbent element to the fluid to be heated as the upper and lower rotors rotate through the second flow passage; and e. bearing means disposed at the lower end of said rotor post for supporting said rotor post for rotation about its vertical axis and for precluding lateral movement thereof.

2. A rotary regenerative heat exchanger comprising:

a. a rotatable central rotor post adapted for rotation about a vertical axis;

b. a lower rotor mounted concentrically about and supported from a lower region of said vertical rotor post, said lower rotor adapted to house a mass of metallic heat absorbent element;

c. an upper rotor mounted concentrically about and supported from an upper region of said vertical rotor post, said upper rotor disposed axially above said lower rotor, said upper rotor adapted to house a mass of ceramic heat absorbent element comprised of a plurality of substantially trapezoidal shaped ceramic blocks disposed in at least two layers about said rotor post, each of said ceramic block having a plurality of axially aligned flow channels extending therethrough and having a pair of side plates disposed along opposite sides thereof adapted to interlock with a neighboring block in an adjacent layer of said upper rotor;

d. housing means surrounding the upper and lower rotors and including inlet and outlet openings at each end thereof, said housing means defining a first flow passage for passing heating fluid therethrough from an inlet at the upper end thereof to an outlet at the lower end thereof and a second flow passage for passing a fluid to be heated therethrough from an inlet at the lower end thereof to an outlet at the upper end thereof, whereby heat will be transferred from the heating fluid to said ceramic and metallic heat absorbent element as the upper and lower rotors rotate through the first flow passage and thence from said ceramic and metallic heat absorbent element to the fluid to be heated as the upper and lower rotor rotate through the second flow passage;

e. a support bearing disposed beneath said rotor post adapted to support said rotor post for rotation about its vertical axis; and f. a guide bearing disposed about said rotor post in the lower region thereof at a location intermediate said lower rotor and said support bearing adapted to preclude lateral movement of said rotor post.

* * * * *